US005954170A

United States Patent [19]

Chisholm

[11] Patent Number: 5,954,170

[45] **Date of Patent: *Sep. 21, 1999**

[54] COMBINATION ORGANIZER AND ACCORDION FILE

[75] Inventor: Claudia J. Chisholm, Evanston, Ill.

[73] Assignee: Kingport International Corporation, Evanston, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/755,102

[22] Filed: Nov. 22, 1996

Related U.S. Application Data

[63] Continuation-in-part of application No. 29/043,723, Aug. 31, 1995, abandoned.

[51] Int. Cl.[6] ..... A45C 3/02; A45C 13/00

[52] U.S. Cl. ..... 190/109; 190/119; 190/900; 190/902; 150/107; 150/118

[58] Field of Search ..... 190/109, 902, 190/900, 119; 150/107, 118

[56] References Cited

U.S. PATENT DOCUMENTS

| | | | |
|---|---|---|---|
| D. 154,119 | 6/1949 | Gumbrill | 150/118 X |
| D. 254,819 | 4/1980 | Harrison | D3/900 X |
| D. 315,985 | 4/1991 | Gerch . | |
| 505,404 | 9/1893 | Frontezak | 150/101 |
| 1,261,159 | 4/1918 | Olwell | 190/902 X |
| 1,329,574 | 2/1920 | Axelman et al. | 190/902 X |
| 1,699,971 | 1/1929 | Johnson | 190/902 X |
| 1,702,905 | 2/1929 | Korchmar | 190/902 X |
| 1,976,390 | 10/1934 | Ferrera | 190/109 X |
| 2,103,281 | 12/1937 | Stanley | 190/902 X |
| 2,316,328 | 4/1943 | Guenther et al. | 190/902 X |
| 2,413,465 | 12/1946 | Ohlsen | 150/118 X |
| 2,523,129 | 9/1950 | Maier | 150/107 X |
| 3,330,388 | 7/1967 | Stein . | |
| 4,262,838 | 4/1981 | Mackenzie | 229/67.4 X |
| 4,420,068 | 12/1983 | Gerch | 190/102 |
| 4,515,493 | 5/1985 | Radovich | 190/902 X |
| 4,790,474 | 12/1988 | Mitsuyama | 229/67.4 X |
| 5,160,001 | 11/1992 | Marceau | 190/902 X |
| 5,217,119 | 6/1993 | Hollingsworth | 190/902 X |
| 5,242,056 | 9/1993 | Zia et al. | 190/119 X |

FOREIGN PATENT DOCUMENTS

| | | | |
|---|---|---|---|
| 735069 | 11/1932 | France | 150/107 |
| 546920 | 3/1932 | Germany | 150/118 |
| 70350 | 9/1915 | Switzerland | 190/109 |
| 1729441 | 4/1992 | U.S.S.R. . | |

*Primary Examiner*—Sue A. Weaver
*Attorney, Agent, or Firm*—James N. Videbeck

[57] ABSTRACT

A briefcase has front, center and rear panels dividing its interior into first and second compartments, the first of which has an accordion file positioned therewithin. A first cover embodiment overlaps the accordion file to close it off, while a second cover embodiment overlaps both first and second compartments. Each cover embodiment has either a U-shaped bight or a rectangular window to allow a handle attached to the briefcase to extend past the cover when the cover is in the closed position.

10 Claims, 5 Drawing Sheets

COMBINATION ORGANIZER AND ACCORDION FILE

This is a continuation-in-part of application Ser. No. 29/043,723, filed Aug. 31, 1995, now abandoned.

The present invention relates to luggage, and in particular, to "business luggage" suitable for carrying documents, including briefcases, attache cases, portfolios and the like.

BACKGROUND OF THE INVENTION

Business luggage, such as briefcases and attache cases, with multiple compartments to facilitate the organization of documents and personal articles such as pens, calculators and credit cards are well known. Such luggage is typically made with rigid or hard bodies, or with flexible or fabric walls defining one or more such compartments. Where such luggage is made with undivided compartments, users must provide file folders or some other method to organize and separate documents or other articles carried therein. It would be desirable to provide luggage which combines attributes of hard-sided and soft-sided cases and which provides structure to sort and hold documents without requiring that they be put into file folders.

SUMMARY OF THE INVENTION

Briefly, the present invention is embodied in an article of business luggage referred to herein as a briefcase which, in a preferred embodiment, has semi-rigid front and rear panels and a center panel dividing the briefcase into two main compartments with the center panel common to both. A first compartment has flexible, pleated side walls attached to the rear panel and the center panel, and a series of longitudinal dividers attached to the pleated sidewalls and extending parallel to the rear and center panels to form an accordion file. The accordion file may have separate front and/or rear planar opposing panels parallel to the rear panel and center panel. Alternatively, the rear panel and/or the center panel may be integral with and serve, respectively, as the front and rear panels of the accordion file.

A second compartment is formed by hingeably attaching the lowermost edge of the front panel to that side of the center panel opposite the accordion file. Organizers are provided in the second compartment on the inner faces of either or both of the center panel or the front panel, or on a second side wall extending between the front and center panels. In one embodiment, one such organizer includes a three ring loose-leaf binder.

The front panel is preferably retained closed parallel to the center panel by a fastener having mating, interengageable strips (a "zipper"), wherein one of said strips extends along the bottom, side and tops edge of the center panel, while the mating strip extends along the complementary edges of that portion of the front panel. A cover, which may be a flexible flap, extends, in a first embodiment, to cover the top of the entire briefcase and, in a second embodiment, to cover the open upper ends of the accordion file, and appropriate handles are provided for carrying the briefcase.

GENERAL DESCRIPTION OF THE DRAWINGS

A better and more complete understanding of the present invention will be had from a reading of the following detailed description taken in conjunction with the accompanying drawings wherein.

DETAILED DESCRIPTION OF THE DRAWINGS

Figure 1:
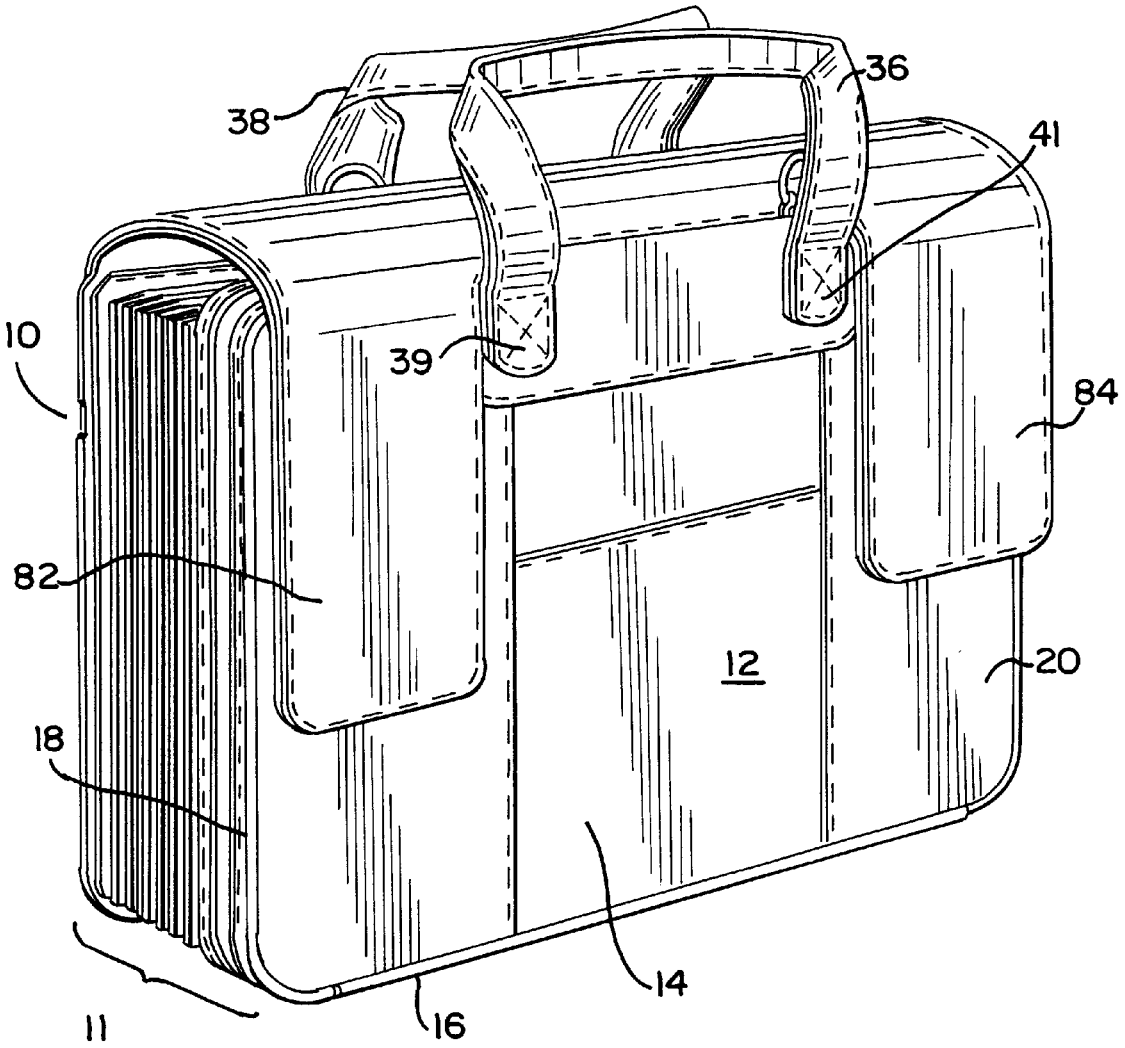
FIG. 1 is a perspective view of a briefcase in accordance with one embodiment of the present invention, showing a front surface and one side thereof.

Referring to FIGS. 1–4, there is shown an article of luggage described herein as a briefcase 10 in accordance with the present invention having a body 11 with a rectangular, rigid or semi-rigid front panel 12 with an outer surface 14, a bottom edge 16, parallel opposing side edges 18, 20, and a top edge 19, respectively. Similarly, a rear panel 22 has a bottom edge 24, parallel opposing side edges 26, 28, and top edge 27, respectively.

Figure 4:
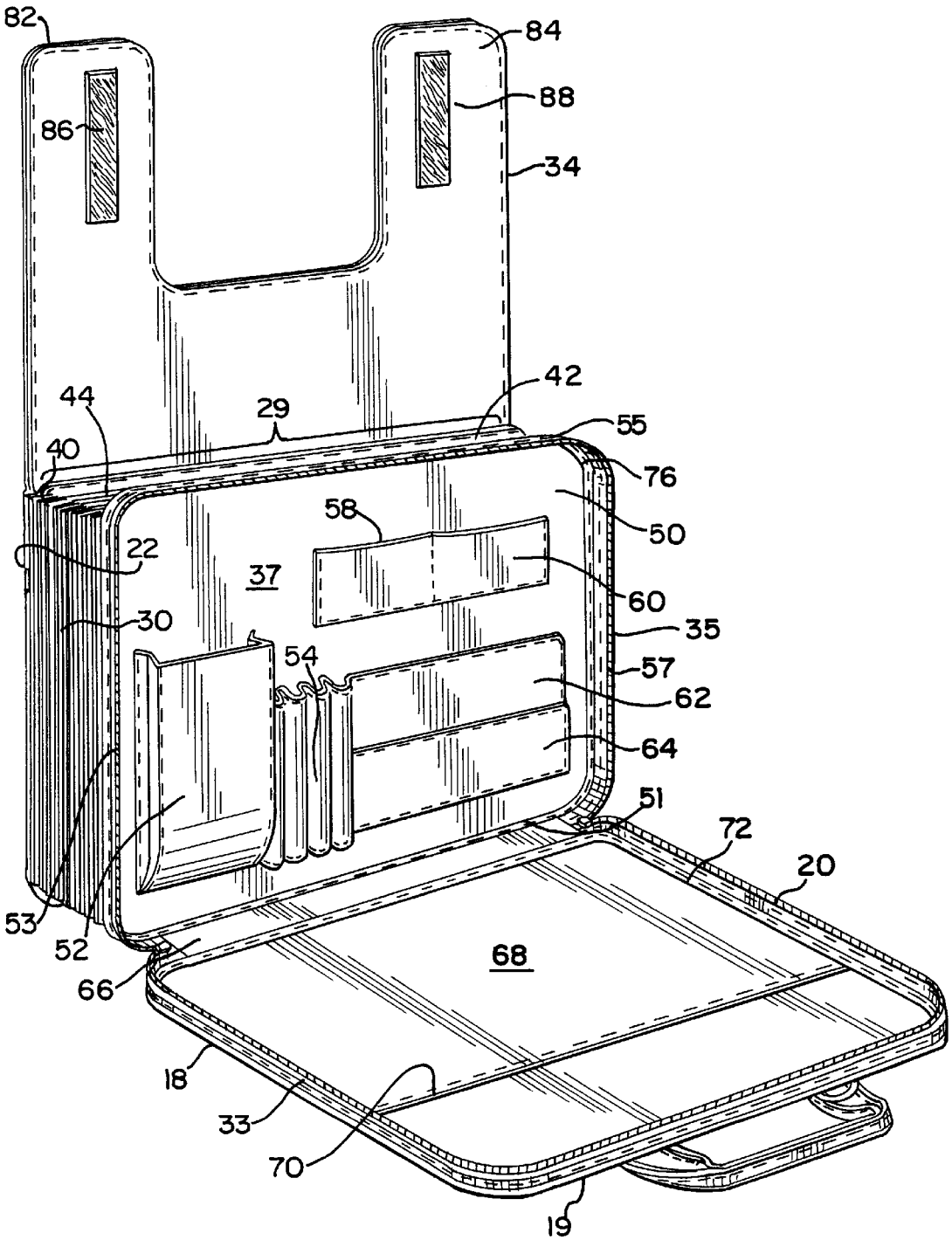
FIG. 4 is a perspective view of the briefcase shown in FIG. 1 with the cover and front panel open to allow access to documents in the accordion file and to items retained in the organizer on the outer surface thereof.

As seen in FIG. 4, briefcase 10 has a center panel 50 substantially parallel to rear panel 22 and having dimensions substantially identical to front panel 12.

Figure 3:
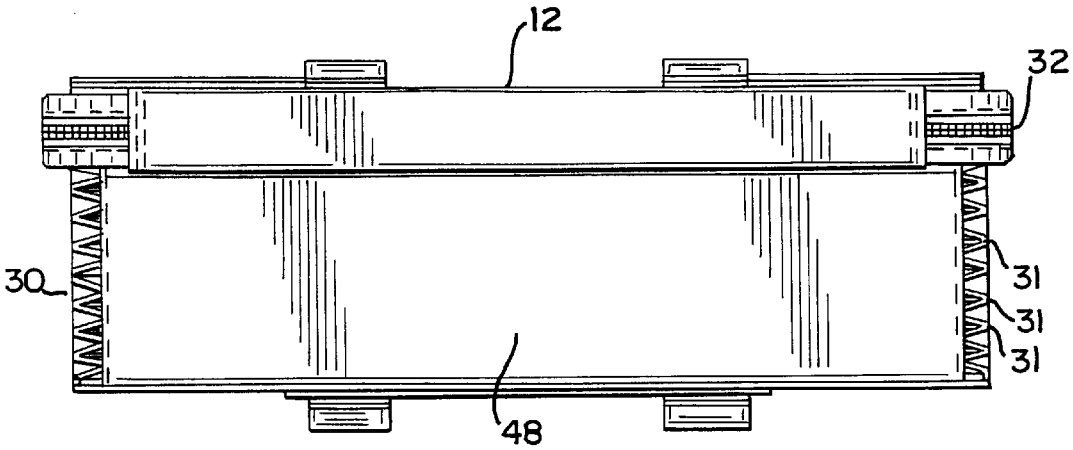
FIG. 3 is a bottom elevational view of the briefcase shown in FIG. 1.

As seen in FIGS. 3 and 4, briefcase 10 has opposed side walls 30 made of flexible material, with each sidewall 30 having a portion thereof in which the flexible material is configured in parallel vertically oriented pleats 31 to form an end of an accordion file as described below.

Referring to FIG. 4, it can be seen that an accordion file 40 having an open upper end 42 is formed by a plurality of planar dividers 44 which extend parallel to rear panel 22 and are attached to pleats 31. As best seen in FIG. 3, a bottom panel 48, fashioned from flexible material, extends between rear panel 22 and center panel 50 to close off the compartments of accordion file 40 and keep documents from falling out of the bottom thereof. Rear panel 22, center panel 50, side panels 30 and bottom panel 48 thus define a first compartment 29 of briefcase 10.

As seen in FIG. 4, front panel 12 is hingeably attached to a bottom edge 51 of center panel 50 by a flexible hinge strip 66. Front panel 12 is selectively moveable from an open position as shown in FIG. 4 to a closed position as seen in FIGS. 1 and 3 by a substantially U-shaped zipper 32 having a first web 33 attached to front panel 12 and extending from bottom edge 16 along side edge 18, top edge 19, side edge 20 and back to bottom edge 16, and a second web 35 attached to center panel 50 and extending from bottom edge 51, side edge 53, top edge 55 and side edge 57 to return to bottom edge 51. When zippered shut, front panel 12, together with center panel 50 and zipper 32 form a second compartment 37 in briefcase 10.

As seen in FIG. 4, center panel 50 preferably has a number of organizers formed thereon to accommodate personal articles, including a pocket 52 suitable for retaining a calculator therein, a plurality of loops 54 of flexible material, each of which is sized to retain a pen or pencil therein, and a plurality of smaller pockets 58, 60, 62 and 64, suitably sized to receive business cards, credit cards and other small objects therein.

Inner surface 68 of front panel 12 preferably has a large pocket 70 for receiving documents and the like. A lip 72 extends along the opposing edges 18, 20 and top 19 of front panel 12, and a complementary lip 76 extends along edges 53 and 57 and top 55 of center panel 50. Lips 72 and 76 preferably serve, respectively, as anchors for securing first and second zipper webs 33 and 35 to briefcase 10.

FIG. 4 also shows a flexible cover 34 attached to or integral and coextensive with rear panel 22. In a first preferred embodiment, cover 34 has upper end flaps 82, 84, respectively, forming a U-shaped bight therebetween and which are adapted to attach to the outer surface 14 of the front panel 12 by any appropriate means. In preferred embodiment, one of a mated pair of a hook and interlocking loop attachment strips 86, 88, is attached to each of flaps 82, 84, and a pair of complementary strips, not shown, is attached to the outer surface 14 of the front panel 12 to engage flaps 82 and 84, and retain cover 34 in a closed position overlapping both compartments 29 and 37 as seen in FIG. 1.

Figure 6:
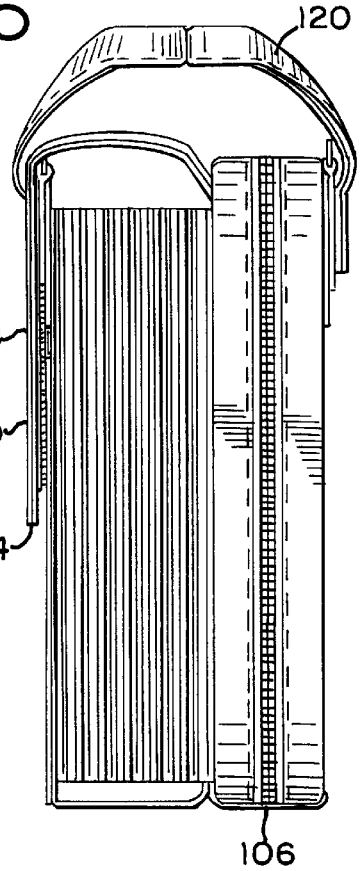
FIG. 6 is an end elevational view of the briefcase shown in FIG. 5.
Figure 5:
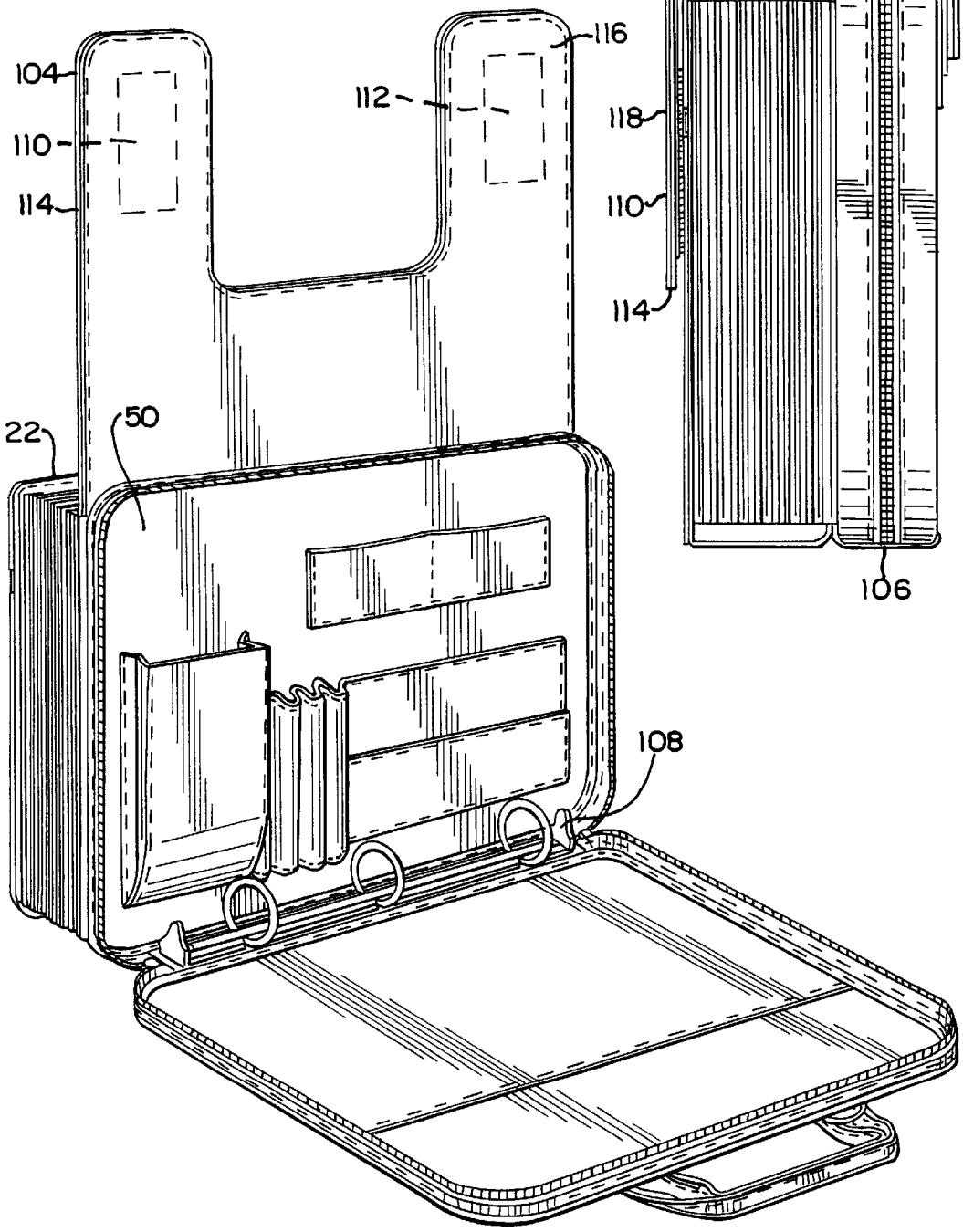
FIG. 5 is a perspective view of a second embodiment of a briefcase in accordance with the present invention with the front panel in the open position, and the cover over the accordion file also in the open position.

In a second preferred embodiment, cover 104 is attached to or is integral and coextensive with center panel 50 as shown in FIGS. 5 and 6 and is securable to rear panel 22, preferably by mating hook-and-loop fastener strips 110, 112, attached to flaps 114 and 116 of cover 104, and 118, attached to rear panel 22 as seen in FIG. 6.

Figure 2:
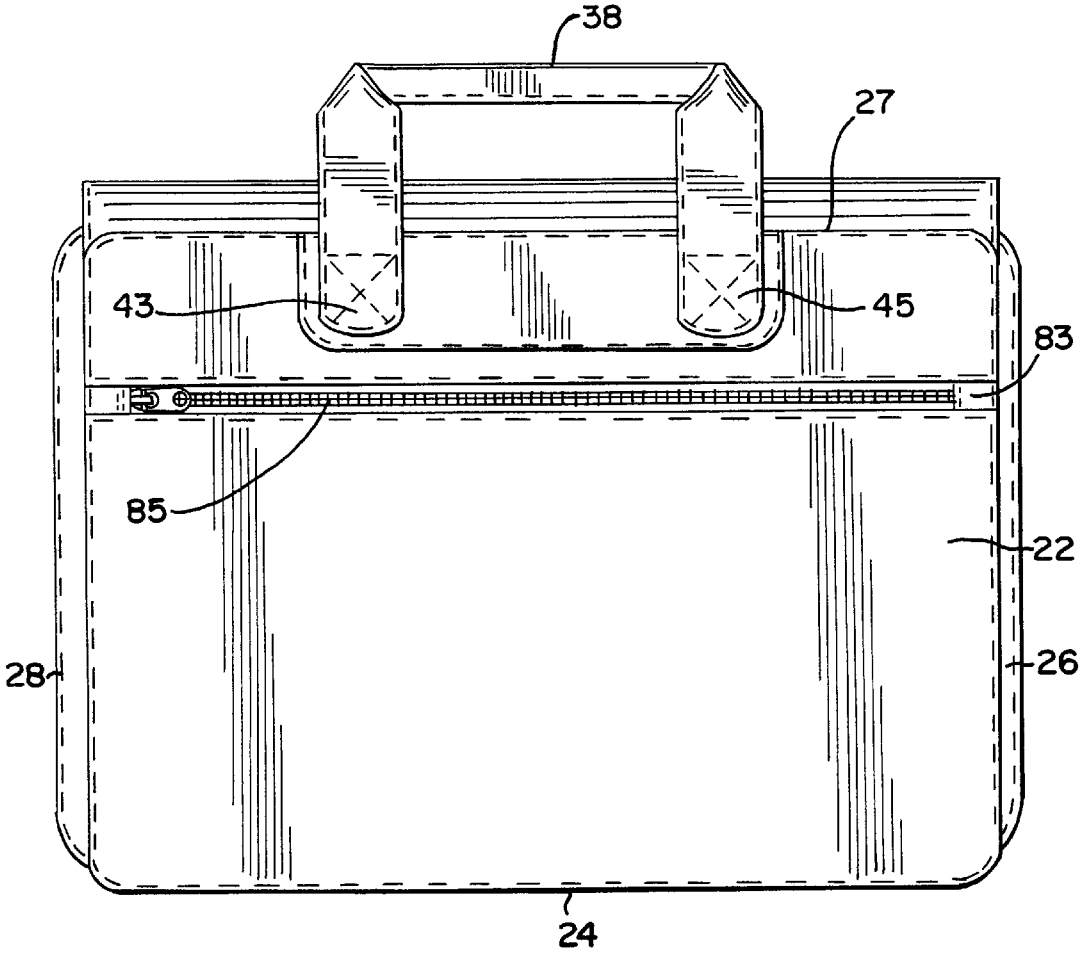
FIG. 2 is a rear elevational view of the briefcase shown in FIG. 1.

As can be seen in FIGS. 1 and 2, a pair of carrying handles 36, 38 are attached to briefcase 10. FIG. 1 shows handle 36 to be generally U-shaped and to be sewn or bartacked to outer surface 14 of front panel 12 at 39 and 41. In FIG. 2, handle 38 is also shown as generally U-shaped and sewn or bartacked to rear panel 22 at 43 and 45.

Figure 8:
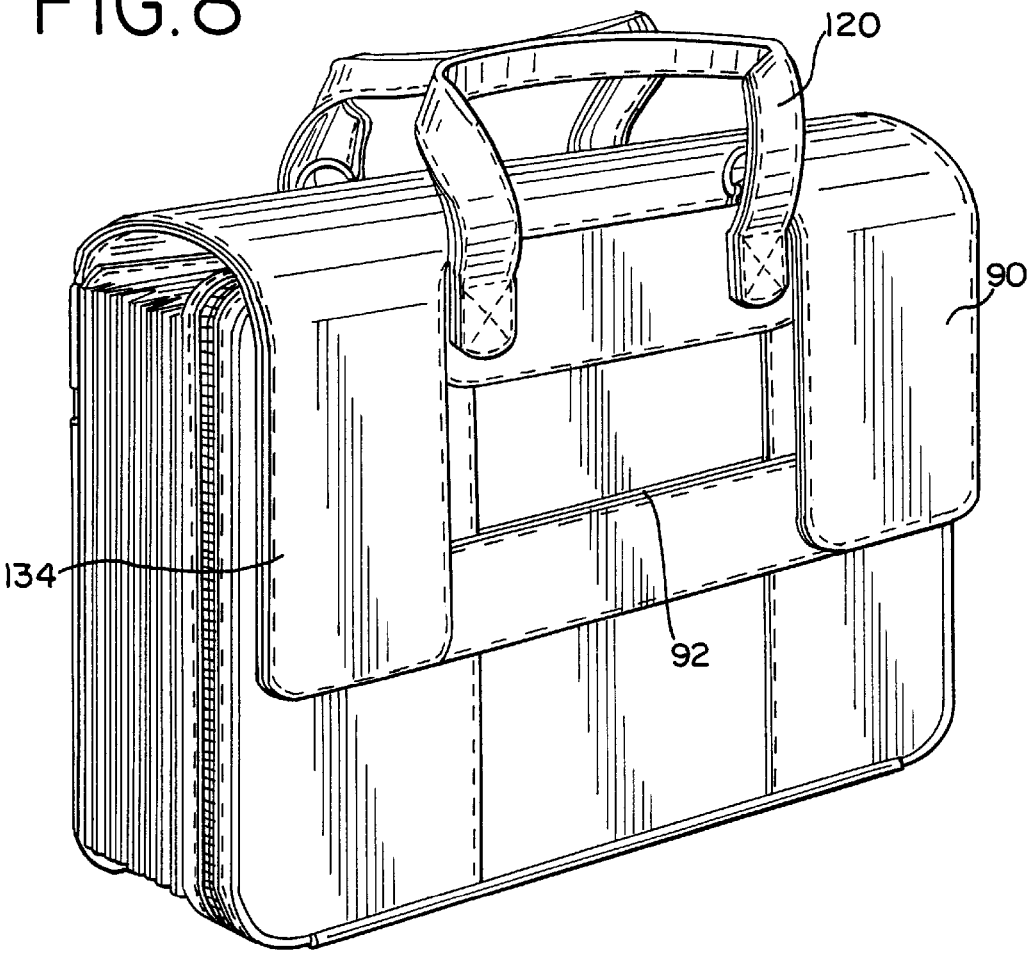
FIG. 8 is a perspective view of another embodiment of the cover flap of FIG. 1.

FIG. 1 also shows the flaps 82, 84 of cover 34 extending to opposite sides of handle 36. In a variation of the construction of FIG. 1, FIG. 8 shows cover 134 formed as a generally rectangular panel 90 with a slot or window 92 formed therethrough through which a handle 120 of the embodiment shown in FIG. 6 or handle 38 of the embodiment shown in FIG. 1 is extended when cover 32 is closed. Handle 120 is attached to front panel 12, as described hereinabove with respect to FIG. 1.

As shown in FIG. 2, a second outside pocket 83 is formed in rear panel 22, access to which is selectively closed off by a zipper 85 positioned parallel to and proximate upper edge 27 of rear panel 22.

Figure 7:
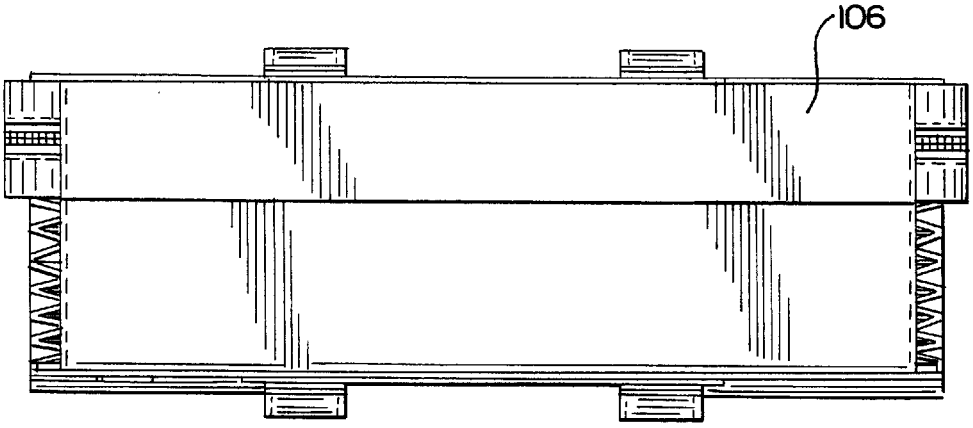
FIG. 7 is a bottom elevational view of the briefcase shown in FIG. 5.

Referring to FIGS. 5, 6 and 7, a second embodiment of a briefcase is shown which, as in the embodiment shown in FIG. 4, has pockets suitable for retaining such personal articles as calculators, pencils, credit cards and the like mounted to center panel 50. As with the prior-described embodiment, front panel 12 is hingeably attached to a bottom edge 51 of center panel 50 by a flexible hinge strip 106.

Attached to flexible strip 106 is a binder apparatus 108 used to retain papers or other documents. In the embodiment shown herein, binder apparatus 108 is shown as a standard, three-ring binder mechanism typically mounted to the spine of a three-ring notebook, intended to hold paper drilled with a standard, three-ring pattern. Other types of paper-retaining mechanisms, or other ring patterns may be selectively utilized as desired.

While the foregoing has presented descriptions of several preferred embodiments of the present invention, it is to be understood that these descriptions are presented by way of example only and are not intended to limit the scope of the present invention. It is expected that others skilled in the art will perceive variations which, while differing from the foregoing, do not depart from the spirit and scope of the invention as herein described and claimed.

What is claimed:

1. An article of luggage comprising in combination:

a generally rectangular front panel having an upper edge;

a generally rectangular rear panel spaced from said front panel and having an upper edge;

a center panel positioned intermediate said front and rear panels;

an accordion file positioned intermediate said center panel and said rear panel, said accordion file comprising a plurality of individual compartments, said accordion file adapted to expand along a direction from said center panel toward said rear panel as said compartments are filled;

means for hingeably opening and closing said front panel against said center panel;

means for retaining said front panel closed against said center panel;

means for carrying said article of luggage, said carrying means including a pair of handles, the first of said handles attached to an exterior surface of said front panel proximate said upper edge, the second of said handles attached to an exterior surface of said rear panel proximate said upper edge; and means for covering said accordion file, said cover means having a generally rectangular cover flap extending from said center panel to cover said accordion file, said cover flap having a free end that extends to overlap a portion of said rear panel, said cover flap having window means formed through that portion of said flap that overlaps said rear panel to allow said second handle to extend through said window means, said window means being relatively larger than said second handle to enable said second handle to extend through said window means when said accordion file is expanded.

2. The article of luggage as recited in claim 1 wherein said window means comprises a pair of flap segments extending from said cover flap free end to form a generally U-shaped bight, said second of said handles positioned on said rear panel to extend through said bight when said cover flap is secured to said rear panel.

3. The article of luggage as recited in claim 2 wherein said article of luggage further comprises means for organizing articles placed within said article of luggage, said organizing means formed on said center panel and an inner surface of said front panel.

4. The article of luggage as recited in claim 3 wherein said organizing means comprises a three-ring notebook paper binder.

5. The article of luggage as recited in claim 3 wherein said plurality of individual compartments in said accordion file includes more than six compartments.

6. The article of luggage as recited in claim 1 wherein said window means comprises a rectangular window formed through said cover flap free end, said second of said handles positioned on said rear panel to extend through said window when said cover flap is secured to said rear panel.

7. An article of luggage comprising in combination:

a generally rectangular front panel having an upper edge;

a generally rectangular rear panel spaced from said front panel and having an upper edge;

a center panel positioned intermediate said front and rear panels;

an accordion file positioned intermediate said center panel and said rear panel, said accordion file comprising a plurality of individual compartments, said accordion file adapted to expand along a direction from said center panel toward said rear panel as said compartments are filled;

means for hingeably opening and closing said front panel against said center panel;

means for retaining said front panel closed against said center panel;

means for carrying said article of luggage, said carrying means including a pair of handles, the first of said handles attached to an exterior surface of said front panel proximate said upper edge and the second of said handles attached to an exterior surface of said rear panel proximate said upper edge; and means for covering said accordion file, said cover means having a generally rectangular cover flap extending from said rear panel to cover said accordion file and having a free end that extends to overlap a portion of said front panel, said cover flap having window means formed through that portion of said flap that overlaps said front panel to allow said first handle to extend through said cover flap, said window means being relatively larger than said first handle to enable said first handle to extend through said window means when said accordion file is expanded.

8. The article of luggage as recited in claim 7 wherein said window means comprises a pair of flap segments extending from said cover flap free end to form a generally U-shaped bight, said first of said handles positioned on said front panel to extend through said bight when said cover flap is secured to said front panel.

9. The article of luggage as recited in claim 7 wherein said window means comprises a rectangular window formed through said cover flap free end, said first of said handles positioned on said front panel to extend through said window when said cover flap is secured to said front panel.

10. The article of luggage as recited in claim 7 wherein said plurality of individual compartments in said accordion file includes more than six compartments.

* * * * *